United States Patent [19]

Owens

[11] Patent Number: 4,926,524

[45] Date of Patent: May 22, 1990

[54] WINDOW PIVOT CORNER

[76] Inventor: George W. Owens, 233 Dove Av., Sebring, Fla. 33870

[21] Appl. No.: 91,742

[22] Filed: Aug. 31, 1987

[51] Int. Cl.[5] ..... E05D 15/22

[52] U.S. Cl. ..... 16/386; 49/176; 49/181

[58] Field of Search ..... 16/386; 49/176, 181

[56] References Cited

U.S. PATENT DOCUMENTS 4,581,850 4/1986 Simpson ..... 49/181

4,763,445 8/1988 Silverman ..... 49/176

*Primary Examiner*—Richard K. Seidel

*Assistant Examiner*—Edward Brown

*Attorney, Agent, or Firm*—Millen, White & Zelano

[57] ABSTRACT

A window unit attachment is described in the form of a pivot corner for a single-hung or double-hung window. The pivot corner comprises a unitary pivot pin to allow tilting of the window and optionally a restraining guide to assure proper orientation of the window. The unitary construction of the pivot corner reduces the number of parts needed for tilting or removable single-hung and double-hung window units to a minimum and simplifies construction of these window units.

11 Claims, 1 Drawing Sheet

FIG. 1
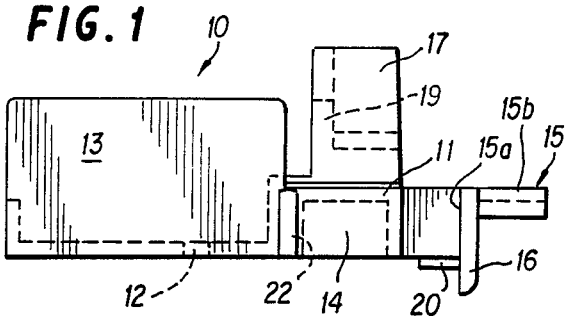
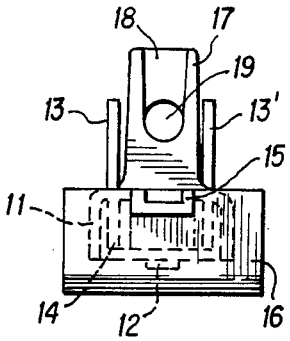
FIG. 3
FIG. 2
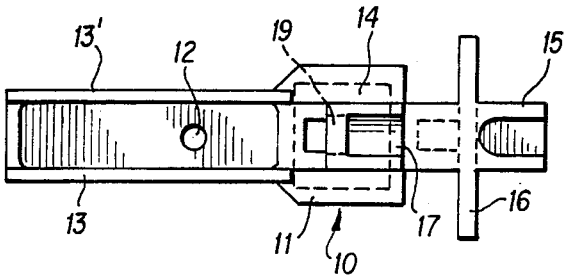
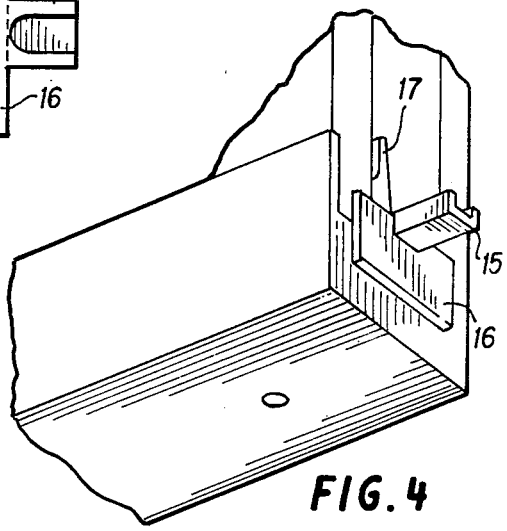
FIG. 4
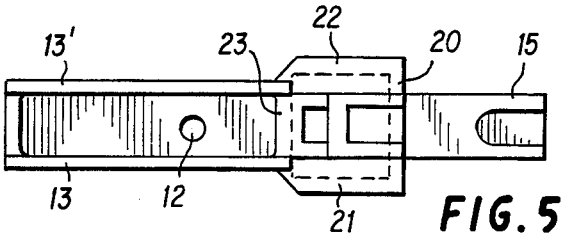
FIG. 5

WINDOW PIVOT CORNER

DESCRIPTION OF THE INVENTION

1. Technical Field of the Invention

The present invention relates to a pivot corner and, more particularly, to a unitary or integral pivot corner used in single-hung and double-hung sash windows.

2. Background Art

U.S. Pat. No. 4,581,850 discloses a known form of a plastic pivot corner for a pivotal sash window. In particular, that form of pivot corner is designed to be installed internally on the sash window frame with a slide guide extending laterally outward of the proximate stile of the frame to engage the guide rail of the master frame jamb. However, even though this pivot corner is characterized as unitary, it employs a separate pivot pin of channel configuration. This arrangement requires the use of another piece in the form of a bolt to secure the pin relative to the corner piece.

Other known forms of window pivot corners suffer from similar disadvantages. They are often complicated in construction and, therefore, expensive to manufacture. Conventional pivot corners require at least two or three parts which requires the maintenance of a more complex and extensive inventory of parts by construction companies and window manufacturers. The need to assemble multiple parts raises labor costs and thus the overall price to the end user. More complicated pivot corner construction can also detract from the overall appearance of the window, in addition to creating the possibility of improper window operation if the various components are not properly made and assembled.

DISCLOSURE OF THE INVENTION

Accordingly, it is a general object of the present invention to overcome the problems and disadvantages encountered in prior pivot corner designs.

Another object of the present invention is to provide a truly single piece, unitary pivot corner which is simple in construction, easily assembled and lower in manufacturing and installation costs than prior art pivot corners.

A more particular object of this invention is to provide a pivot corner which has a pivot pin unitary therewith and means for attaching the same easily to a window sash.

Upon study of the specification and appended claims, further objects, features and advantages of the present invention will become more fully apparent to those skilled in the art to which this invention pertains.

BEST MODE FOR CARRYING OUT THE INVENTION

Briefly, the above and other objects, features and advantages of the present invention are attained in one aspect thereof by providing a unitary pivot corner adapted to be used in a hung window construction to permit tilting of an associated window unit, comprising a unitary body, means associated with said body for attaching the body to frame members of a sash in a window unit, pivot pin means extending integrally from the body for permitting tilting movement of the associated hung window unit, and restraining guide means integrally joined between the pivot pin means and the body.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure in any way whatsoever.

BRIEF DESCRIPTION OF THE DRAWINGS

Referring to the annexed drawings, like or corresponding reference characters refer to like or corresponding parts in the several figures, wherein:

FIG. 1 is a front elevational view of the pivot corner in accordance with the present invention;

FIG. 2 is a top plan view of the pivot corner shown in FIG. 1;

FIG. 3 is an end elevational view of the pivot corner shown in FIG. 1;

FIG. 4 is a perspective view showing generally how the pivot corner of the present invention is installed in a bottom corner of a sash window; and FIG. 5 shows a modification of the pivot corner of FIGS. 1–4 without a restraining guide for use in lower sash windows.

DETAILED DESCRIPTION

Inasmuch as the present invention concerns the new and unobvious construction of a pivot corner and not its method of installation or operation on a window assembly, it is not deemed necessary to discuss the window assembly with which the pivot corner can be used. As evidenced by U.S. Pat. No. 4,581,850, these aspects are generally well known in both single-hung and double-hung sash windows. It is sufficient to note that the pivot corner of the present invention can be mounted at the corner of an upper frame on single- and double-hung sash windows having constructions of the type shown, e.g. in U.S. Pat. Nos. 2,615,540; 3,524,282; 3,861,082; 3,959,926; 4,144,674; 4,271,631; and 4,590,708. FIG. 4 shows generally how the new pivot corner shown in FIGS. 1–3 can be assembled in the bottom corner of an upper sash window, with many details omitted from the drawing for clarity of understanding. The modified pivot corner of FIG. 5, lacking restraining guide 16, can similarly be used in the bottom corner of a lower sash window.

It should also be noted that the unique integral pivot corner of the present invention can be used with conventional slide units which contain pivotal means. By means of this arrangement, the window is free for vertical sliding movement when it is in its normal position. When the window is tilted with respect to its normal vertical plane, the window can either be removed from the window unit or, alternatively, firmly held in the tilted position by a known cam arrangement so that the window can be cleaned.

The presently preferred pivot corner embodiment is designated generally by numeral 10 in FIG. 1. Although the dimensions are not particularly critical and will vary from window unit to window unit because of different opening sizes, nevertheless it may be useful to set forth typical dimensions to show relative size. For instance, the overall length of the unit in FIG. 1 can be about 2.75 inches and have a height of approximately one inch. Likewise, the width of the restraining guide, to be more particularly described hereinafter, can also be approximately one inch. For ease of fabrication, the pivot corner unit can be molded from zinc alloy or other suitable materials which achieve the objectives of the present invention.

Pivot corner 10 has a general body attaching portion 11 which is preferably provided with an aperture or round bore in a wall **11*b* 12 so that a screw or bolt can be used to secure the corner 10 at the appropriate location at a corner of a window sash. The body portion 11 is preferably provided with longitudinally extending wall portions or flanges 13, 13' defining a space therebetween, and optionally a well area 14 defined by lateral outer wall 20, longitudinally extending outer walls 21 and 22 and lateral inner wall 23 of the body in order to reduce the weight of the pivot corner without any sacrifice in strength or durability. A channel-shaped pivot pin 15 extends integrally from a side of the body 11 and is intended to cooperate with a well known pivoting structure on a proximate stile to permit pivoting of the window to a desired position or for removal. For use in upper sash windows, a restraining guide 16 is integrally associated with the body portion 11 and pivot pin 15. The restraining guide 16 cooperates with conventional guide rails of the type shown in FIG. 2** of U.S. Pat. No. 4,581,850 formed in a stile or jamb of the window unit to assure proper orientation of the sash and permit vertical sliding of the window in a fixed plane. As this guide interferes with use of the pivot corner in lower sash windows currently available, it can be deleted as desired.

Another member, lug 17, extends from the body 11 between, on one hand, wall portions 13, 13' and, on the other hand, restraining guide 16 and pivot pin 15. The lug 17 also has a recess 18 for weight reduction considerations and is also provided with a wall having a bore 19 for securing the pivot corner 10 in a window sash corner.

When assembled in a window sash as shown in FIG. 4 with screws or fasteners extending through the sash members to pass through bores 12 and 19, the restraining guide 16 will extend sufficiently from the corner of the sash to engage a slide guide on the proximate stile of the master frame jamb to permit vertical movement of the window sash.

It will now be more readily appreciated that the pivot corner according to the present invention can be used with a wide variety of window constructions without the need for major design modifications. The unitary feature reduces the number of parts needed for inventory as well as construction costs.

Without further elaboration, it is believed that one skilled in the art can, using the preceding description, utilize the present invention to its fullest extent. From the foregoing description, one skilled in the art to which this invention pertains can easily ascertain the essential characteristics thereof and, without departing from the spirit and scope of the present invention, can make various changes and modifications to adapt it to various usages and conditions.

The pivot pin 15 is stepped to form a relatively thick portion **15*a* and a relatively thin portion 15*b*. The relatively thick portion 15*a* has rib 20 projecting therefrom and extending in the direction of the pivot pin 15. The rib 20 extends in the opposite direction from the lug 17**.

Industrial Applicability

As can be seen from the present specification and examples, the present invention is industrially useful in providing a pivot corner which has a pivot pin integral therewith and means for attaching the same easily to a window sash.

What is claimed is:

1. A corner pivot for mounting in a sash of an associated window hung between side rails of a window frame to permit tilting of the window, comprising in a molded, single-piece, unitary body (a) an attaching portion having a wall with a first bore therethrough for receiving a first screw, the attaching portion being received within the sash of the associated window; (b) a lug unitary with the single-piece, unitary body and extending in a direction perpendicular to the wall of the attaching portion, the lug having a second bore therethrough opening in a direction substantially perpendicular to that of the bore through the wall for receiving a second screw that extends substantially perpendicular with respect to the first screw; and (c) a projecting pivot pin unitary with the molded, single-piece, unitary body and extending therefrom in a direction substantially parallel with the wall of the attaching portion for engagement with the adjacent side rail of the window frame for permitting tilting as well as sliding of the window, wherein a molded, unitary, single-piece corner pivot with a projecting pivot pin is provided, which corner pivot is retained in the sash by a first screw received in the bottom wall and a second screw received through the lug.

2. The corner pivot of claim 1, wherein the corner pivot is molded as a metal casting.

3. The corner pivot of claim 2, wherein the metal is a zinc alloy.

4. The corner pivot of claim 1, wherein the attaching portion is channel-shaped.

5. The corner pivot of claim 1, wherein the attaching portion includes a pair of substantially parallel flanges extending substantially perpendicular to the wall in the same direction as the lug.

6. The corner pivot of claim 5, wherein the molded, single-piece, unitary body has a well disposed therein between the pivot pin and the channel-shaped portion, the well being hollow and in alignment with the lug, and the pivot pin extending only away from the well.

7. The corner pivot of claim 1, wherein the bores are circular.

8. The corner pivot of claim 1, further including a plurality of guide flanges unitary with the pivot pin and extending laterally of the pivot pin in a direction substantially perpendicular to the wall and parallel to the direction of the lug, the guide flanges being in spaced relation with respect to the lug so as to define a restraining guide.

9. The corner pivot of claim 8, wherein the pivot pin includes a step therein formed at the location of the guide flanges to define a relatively thick and a relatively thin portion, with the thick portion being disposed between the pair of guide flanges and the lug and the thin portion extending beyond the guide flanges; a projection extending from the thick portion.

10. The corner pivot of claim 9, wherein the projection is a rib coextensive with the pivot pin and projecting in a direction opposite the lug.

11. The corner pivot of claim 1, wherein the pivot pin includes a step therein defining a relatively thick and a relatively thin portion, a rib on the relatively thick portion, the rib being coextensive with the pivot pin and protruding in a direction opposite the direction of the lug.

* * * * *